US008079923B2

(12) United States Patent
Siefker

(10) Patent No.: US 8,079,923 B2
(45) **Date of Patent: *Dec. 20, 2011**

(54) GOAL SHOT TRAINING SYSTEM AND METHODS

(76) Inventor: Aaron Glenn Siefker, Newport Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/876,017

(22) Filed: Sep. 3, 2010

(65) Prior Publication Data

US 2010/0330544 A1 Dec. 30, 2010

Related U.S. Application Data

(62) Division of application No. 11/781,123, filed on Jul. 20, 2007, now Pat. No. 7,811,184.

(60) Provisional application No. 60/807,913, filed on Jul. 20, 2006.

(51) Int. Cl.
*A63B 69/00* (2006.01)

(52) U.S. Cl. ..... 473/446; 473/422

(58) Field of Classification Search ..... 473/476, 473/478, 446, 422, 415; 273/400, 398, 402
See application file for complete search history.

(56) References Cited

U.S. PATENT DOCUMENTS

| | | | | |
|---|---|---|---|---|
| 3,840,228 | A * | 10/1974 | Greaney | 473/446 |
| 4,921,257 | A * | 5/1990 | Heller | 473/446 |
| 4,948,147 | A * | 8/1990 | Pallanca | 273/402 |
| 5,634,640 | A * | 6/1997 | McCarrel | 473/446 |
| 5,902,194 | A * | 5/1999 | Wade | 473/446 |
| 6,264,572 | B1 * | 7/2001 | Matheson et al. | 473/446 |
| 6,926,624 | B1 * | 8/2005 | Witzke | 473/446 |
| 2004/0259667 | A1 * | 12/2004 | Berdugo et al. | 473/446 |
| 2005/0049089 | A1 * | 3/2005 | Pakieser | 473/446 |

FOREIGN PATENT DOCUMENTS

| | | | | |
|---|---|---|---|---|
| CA | 1227818 | * | 10/1987 | 273/127 |

* cited by examiner

*Primary Examiner* — Gene Kim
*Assistant Examiner* — M Chambers
(74) *Attorney, Agent, or Firm* — Eric L. Lane; Luce, Forward, Hamilton & Scripps LLP

(57) ABSTRACT

A soccer training system is used to condition soccer players to make shots at the goal with an improved likelihood of scoring by conditioning the soccer players to aim towards the areas of the goal where shots are more likely to score. Similarly disclosed is a novel method of conditioning soccer players to improve their ability to score goals.

14 Claims, 8 Drawing Sheets

GOAL SHOT TRAINING SYSTEM AND METHODS

RELATED APPLICATIONS

This application is a divisional application of and claims the Paris Convention priority of U.S. Utility patent application Ser. No. 11/781,123, filed on Jul. 20, 2007, now U.S. Pat. No. 7,811,184 the contents of which are expressly incorporated by reference herein, which application claims the priority of U.S. Provisional Application Ser. No. 60/807,913, filed 20 Jul. 2006 entitled "Goal Shot Training System and Methods," the contents of which are incorporated by reference herein in its entirety.

BACKGROUND

Disclosed is a sports training and skill improvement system and related methods.

SUMMARY

A soccer training system is used to condition soccer players to make shots at the goal with an improved likelihood of scoring by teaching the soccer players to aim towards the areas of the goal where shots are more likely to score. Similarly disclosed is a novel method of conditioning soccer players to improve their ability to score goals.

According to a feature of the present disclosure, a system is disclosed comprising at least one positive viewing space and at least one negative viewing space. The system is affixed to a target area, wherein participants may improve their ability to place objects in the target area by conditioning themselves to target the positive viewing spaces.

According to a feature of the present disclosure, a method is disclosed comprising providing a goal shooting training system, the goal shooting training system further comprising at least one positive viewing space and at least one negative viewing space, and at least one connector for connecting the goal shooting training system to a soccer goal. The goal shooting training system is affixed to a soccer goal to condition players to shoot at the at least one positive viewing space when the goal shooting training system is absent.

According to a feature of the present disclosure, a method is disclosed comprising improving the ability of soccer players to score goals by providing a goal shooting training system having at least one positive viewing space and at least one negative viewing space. The improvement in ability comprises conditioning the soccer players to look at locations within a goal wherein the soccer player has an improved likelihood of scoring a goal.

DRAWINGS

The above-mentioned features and objects of the present disclosure will become more apparent with reference to the following description taken in conjunction with the accompanying drawings wherein like reference numerals denote like elements and in which.

DETAILED DESCRIPTION

Figure 1:
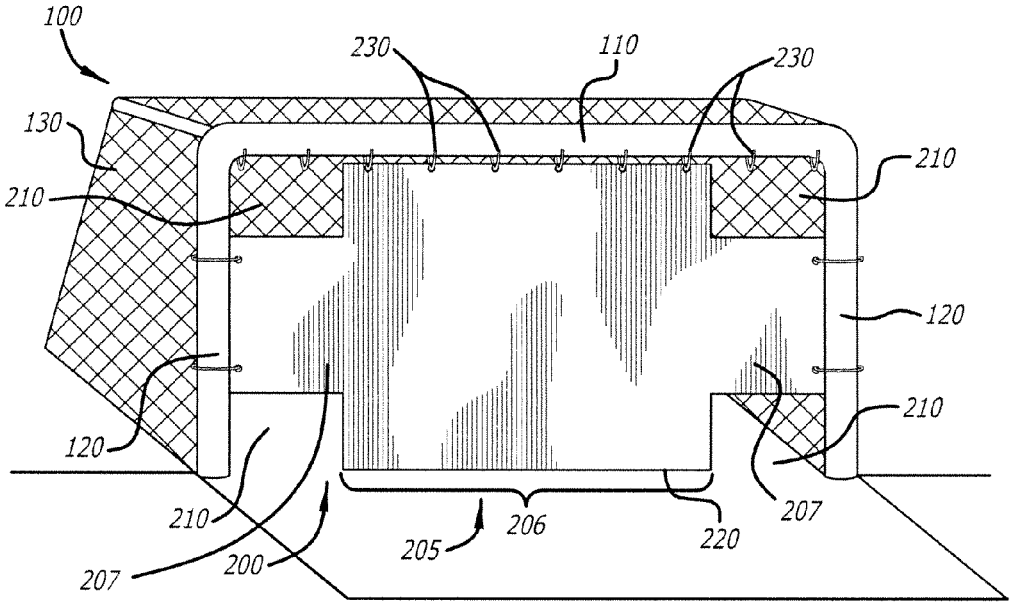
FIG. 1 is a front view of an embodiment of a soccer goal shot training system.

In the following detailed description of embodiments of the invention, reference is made to the accompanying drawings in which like references indicate similar elements, and in which is shown by way of illustration specific embodiments in which the invention may be practiced. These embodiments are described in sufficient detail to enable those skilled in the art to practice the invention, and it is to be understood that other embodiments may be utilized and that logical, mechanical, biological, electrical, functional, and other changes may be made without departing from the scope of the present invention. The following detailed description is, therefore, not to be taken in a limiting sense, and the scope of the present invention is defined only by the appended claims. As used in the present disclosure, the term "or" shall be understood to be defined as a logical disjunction and shall not indicate an exclusive disjunction unless expressly indicated as such or notated as "xor."

The term "viewing space" as used in this application refers to a region of a goal that a player aims for when shooting.

Soccer players train with the end goal of scoring goals by moving a ball into a goal. The goal is a target defined by two posts and a cross bar connecting the posts. The posts of a regulation soccer goal are 24 feet apart, and the cross bar is 8 feet high. Typically, a net is hung behind the goal to stop the ball and more easily determine when a goal is scored.

Players, with the exception of the goalkeeper, may use any part of their body except for their arms and hands to move the ball towards the goal. The goalkeeper comprises the last defense and may use any part of their body, including their arms and hands, to prevent the opposing players from scoring a goal. The goalkeeper is positioned in front of the goal and presents an obstacle that opposing players must overcome.

Under most circumstances, the ball is moved into the goal by kicking the ball or by striking the ball with the head—"heading the ball." Soccer players develop the ability to precisely shoot the ball though the goal. In order to strike the ball with precision and hard enough to evade the goalkeeper, the players often "set up the shot." To set up the shot, the player looks up to the goal to aim the shot and decide how the ball will be struck. Thereafter, the soccer player looks down at the ball immediately prior to kicking it to accurately strike the ball, allowing the player to vary the spin and vertical elevation of the shot. The entire process may take less than a second. Thus, most of the "decisions" involved in setting up the shot are instinctive as a result of long hours of practice.

The process of looking up and taking aim occurs in a relatively short period of time. Players must therefore train to rapidly recognize and make adjustments to their shots in short time periods of often less than a second. Player's eyes tend to be attracted first to the movement of the goalkeeper after setting up the shot. Because players tend to shoot the soccer ball at the first object they see in the goal area, they tend to shoot the ball directly at the goalkeeper, the area where the player is least likely to score a goal. However, if soccer players are trained to first see a different part of the goal where the likelihood of scoring is increased, the players will have a better likelihood of scoring. For example, if a soccer player trains to see to the corners of the goal first after setting up the shot, rather than seeing the goalkeeper first, the likelihood of scoring a goal is greatly increased. Thus, a new method of training soccer players is needed, which helps condition players to see a higher likelihood of scoring areas of the goal first and to shoot at these areas.

The present disclosure is designed to train soccer players to see parts of the goal in which the player is most likely to score. The systems and methods of the present disclosure deemphasize the areas covered by the goalkeeper using negative viewing spaces and emphasize the areas in which players are most likely to score goals using positive viewing spaces. Consequently, when a soccer player looks up to the goal after setting up the shot, the players become conditioned to see the areas most likely to score a goal and will consequently shoot the ball towards those areas rather than at the goalkeeper.

According to an embodiment of the present disclosure shown in FIG. 1, there is shown goal 100. Goal 100 comprises the target area of goal 100 defined by two posts 120 connected by crossbar 110 on the top. The soccer end line comprises the bottom of the goal. Goal shooting training system (GSTS) 200 is provided to condition players to shoot towards the most effective areas in goal 100.

According to embodiments, GSTS 200 comprises goal cover 205. Goal cover 205 may be made of cloths (such as canvas), vinyl, polypropylene, polyethylene, and other materials that are able to withstand the impact of soccer balls without tearing or becoming dislodged. Such materials are known to persons of ordinary skill in the art. Goal cover 205 further comprises both positive viewing spaces 210 and negative viewing spaces 220. These spaces are designed to attract the eye or repel the eye, respectively.

According to embodiments, goal cover 205 is connected to crossbar 110. Goal cover 205 connects to GSTS connectors 230, which are installed on crossbar 110. GSTS connectors 230 comprise hooks and openings, for example. If hooks, goal cover 205 may have grommeted openings which may be placed over GSTS connector 230 and which correspond positionally to the location of GSTS connector 230 on crossbar 110. In an embodiment GSTS connector 230 comprises openings. Ropes, cords, strings, hooks, wires, or equivalents may be inserted into the opening. The ropes, cords, strings, hooks, wires, or equivalents are also connected to goal cover 205, as would be known to a person of ordinary skill in the art for the purpose of hanging a curtain-like structure. Other connection methods, such as with rope weaving or lashing are common in the art and known to a person of ordinary skill in the art.

According to an embodiment, positive viewing spaces 210 comprise openings in goal cover 205. These openings allow both a soccer ball to pass into the area behind the goal. More importantly, the openings allow the soccer player to quickly locate an unobstructed target to aim for. That is, when a soccer player looks to goal 100 after setting up the shot, positive viewing spaces 210 are the goal areas in which the soccer player can see net 130. By training themselves to look for openings in goal cover 205, soccer players become conditioned to look first for the high probability scoring areas of the goal after setting up the shot, which increases the likelihood of shooting the balls to those areas. Although negative viewing spaces 220 are generally intended to be covered, positive viewing spaces 210 may either be covered with a pattern or color, such as a light color, that causes the player to look first at the positive viewing space or form openings in goal cover 205 through which a soccer ball may travel to simulate actually kicking a scoring shot.

Because GSTS 200 is placed very close to the imaginary plane the ball must cross to score a goal, use of GSTS 200 conditions a player to aim at areas of the goal where a scoring shot is the likeliest. Moreover, as part of the conditioning process and when the positive viewing spaces 210 are open, the conditioning is reinforced by correctly placed shots actually "entering" the goal and stopped by the net. Conversely, when the shot is incorrectly placed, GSTS 200 stops the ball as if an actual goal keeper had stopped the ball. The cumulative effect conditions the players to shoot for the spaces where the player is "rewarded" by kicking the ball past GSTS 200 and into the goal as if a goal keeper were present. Thus, when GSTS 200 is absent, the player will be preconditioned to shoot at the spots where they are most likely to score.

According to embodiments, positive viewing spaces 210 comprise a uncovered, light, or bright colored areas of goal cover 205. After setting up the shot, players will be instructed to look for light or bright spaces and shoot for those areas. Consequently, the players will become conditioned to shoot to the light or bright colored areas of GSTS 200, even when the GSTS 200 is not in place.

Referring still to an exemplary embodiment represented in FIG. 1, negative viewing spaces 220 of GSTS 200, are designed to be deemphasized when a player looks to goal 100 after setting up a shot. Deemphasis of negative viewing spaces 220 conditions players to first see positive viewing spaces 210 by instinct. Thus, the soccer player will be less likely to shoot at negative viewing spaces 220 and more inclined to initially see positive viewing spaces 210 and shoot to those areas. In embodiments, negative viewing spaces 220 are darkly colored spaces. When a player looks to the goal after setting up the shot, they will be trained to look for positive viewing spaces 210. Consequently, the player will become conditioned to avoid the negative, or dark colored, viewing spaces 220 altogether in favor of positive, or light colored/open viewing spaces 210 when they look up to goal 100 after setting up a shot in the absence of GSTS 200.

Moreover, according to embodiments, negative viewing spaces 220 may be shaped to imitate the range of a goalkeeper. For example, negative viewing spaces 220 may be roughly cross-shaped to imitate the range over which a goalkeeper is likely to make a save. For example, goal cover 205 comprises goal cover central portion 206 roughly imitating the range of a goal keeper's body, and goal cover side extensions 207 roughly imitating the range of a goal keeper's arms. Thus, soccer players who train with GSTS 200 will become conditioned to shoot to areas where the goalkeeper is less likely to stop shots, improving their chances for scoring a goal by aiming the ball to areas of the goal that have a higher likelihood of successfully passing through the goal.

Figure 2:
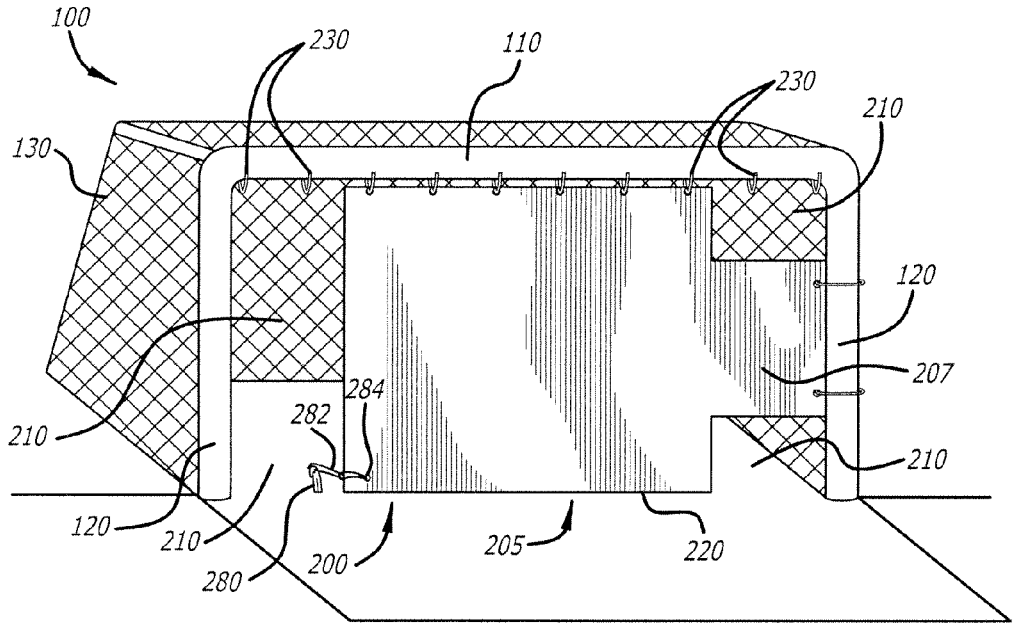
FIG. 2 is a front view of an embodiment of a soccer goal shot training system.

According to embodiments shown in FIG. 2, GSTS 200 may be positioned differently depending on the angle of the shot. When a shooter moves the ball to the right of the field and goal, for example, the goalkeeper typically shifts slightly to the shooter's right. The keeper's shift reflects the greater difficulty in shooting a ball to the far post 120 versus shooting the ball to the near post 120. By shifting positions, the goalkeeper reduces likelihood of a scoring shot by covering the areas comprising the easiest shots for the shooter over the entire area of goal 100.

To reflect the changed likelihood for scoring shots induced by the goalkeeper's shift in position, GSTS 200 may be modified, e.g., by repositioning, to reflect the changed shot success likelihood circumstances induced by the goalkeeper's change in position, according to embodiments. When the shooting team moves the ball to the right side of the field, the goalkeeper moves to the right as well, creating a space in the left part of goal 100 that cannot be covered by the keeper. Thus, GSTS 200 may be repositioned so that the negative viewing spaces 220 would be positioned in the right of the goal, while creating additional positive spaces 210 in the left part of the goal where the goalkeeper cannot easily protect, as shown in FIG. 2.

According to an embodiment, a portion of goal cover 205 may be hidden behind the remainder of goal cover to simulate the opening of additional positive viewing space 210 that would exist in the left part of goal 200 when the shot comes from the right side of the field, as previously described. According to this embodiment, a portion of goal cover 205 with negative viewing space 220 may be folded backwards and suspended from the same GSTS connectors 230 as other portions of goal cover 205. The net result "removes" a portion of goal cover 205 containing a portion of negative viewing space 220. Thus, when shooting from the sides, shooters would be conditioned to shoot towards the far post by conditioning themselves to look first at far post 120, corresponding to positive viewing spaces 110. The process is reversed for shots from the left side of the soccer field.

The change in positive viewing spaces 210 reflecting the variations in likelihood of successful shots at the goal, measured as a function of where the ball is shot with respect to areas of the goal, may be accomplished by shifting goal cover 205 according to an embodiment. Shifting goal cover 205 moves negative viewing spaces 220 to the right from the shooter's perspective, creating additional positive viewing space 210 in the left part of the goal. Thus, additional positive viewing spaces 210 may be accomplished by shifting entire goal cover 205, according to the exemplary embodiment.

Figure 3:
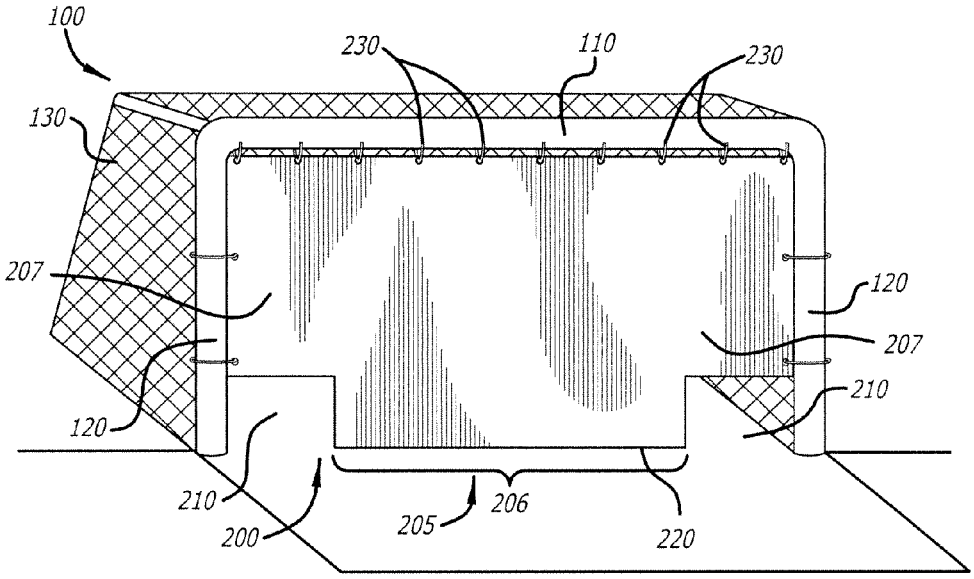
FIG. 3 is a front view of an embodiment of a soccer goal shot training system.

According to an embodiment shown in FIG. 3, the teachings of the present disclosure may also be used to condition players to shoot specific type shots. For example, FIG. 3 shows goal cover 205 where positive viewing spaces 210 exist only close to the ground. Using this embodiment, players with difficulty shooting low shots may train and condition themselves to shoot shots at goal 100 close to the ground. Other, similar embodiments, such as shooting for the top corners of the goal may similarly be used and would be well known to a person of ordinary skill in the art.

Figure 4:
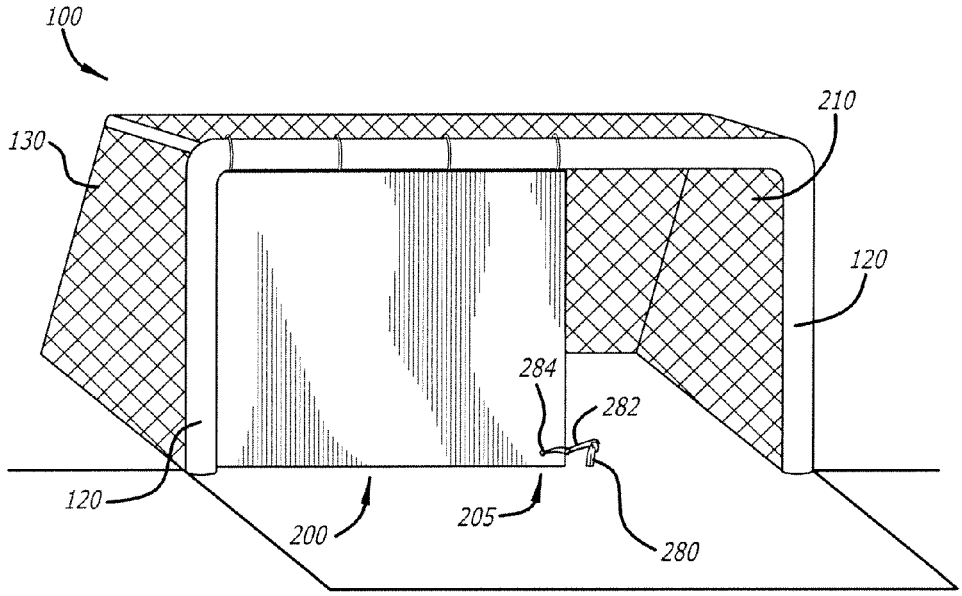
FIG. 4 is a front view of an embodiment of a soccer goal shot training system.
Figure 5:
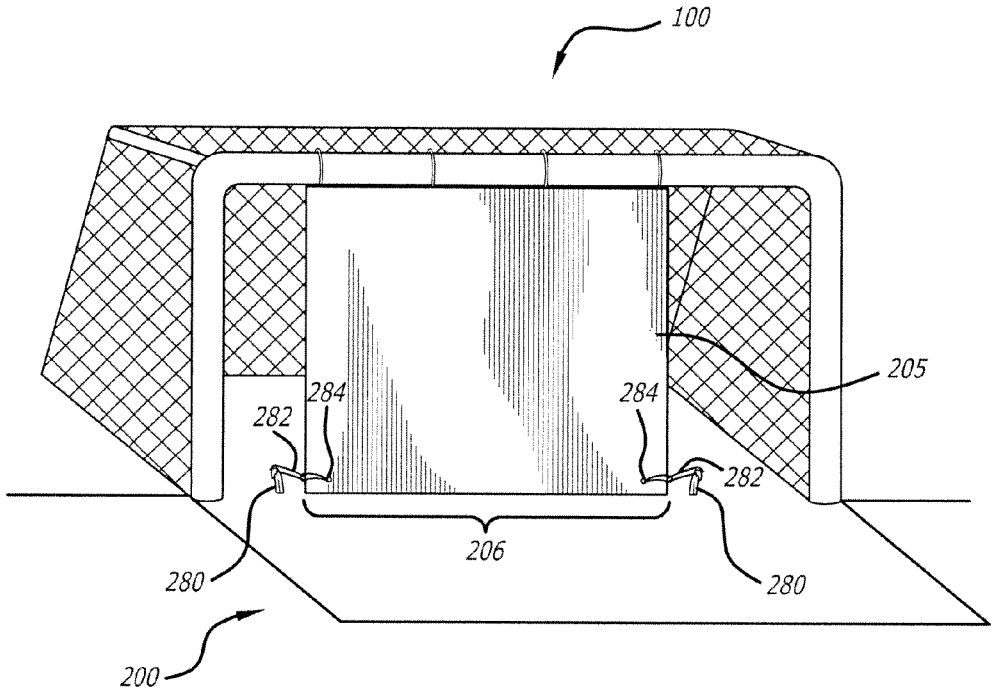
FIG. 5 is a front view of an embodiment of a soccer goal shot training system.

Similarly according to embodiments and as illustrated in FIG. 4, players may be conditioned to shoot at the far post of the goal by configuring GSTS 200 to completely obscure one side of the goal thereby forcing the player to shoot at the opposite side. According to similar embodiments and as illustrated in FIG. 5, GSTS 200 may be deployed asymmetrically across the goal depending on the specific training goals sought, as will be known and understood by artisans.

Figure 6A:
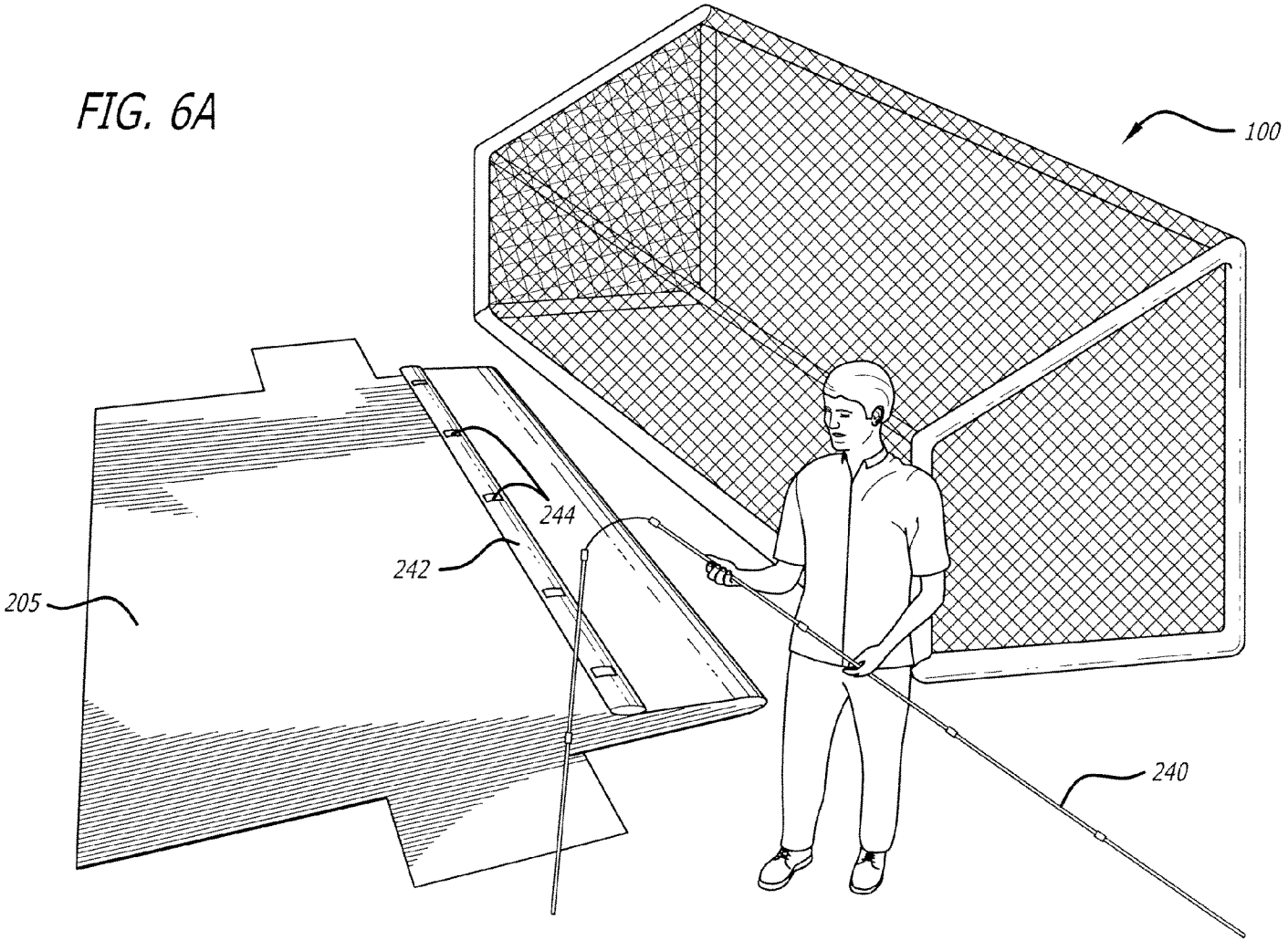
FIGS. 6A and 6B are perspective views of an embodiment of a method for connecting a soccer goal shot training device to a soccer goal.
Figure 6B:
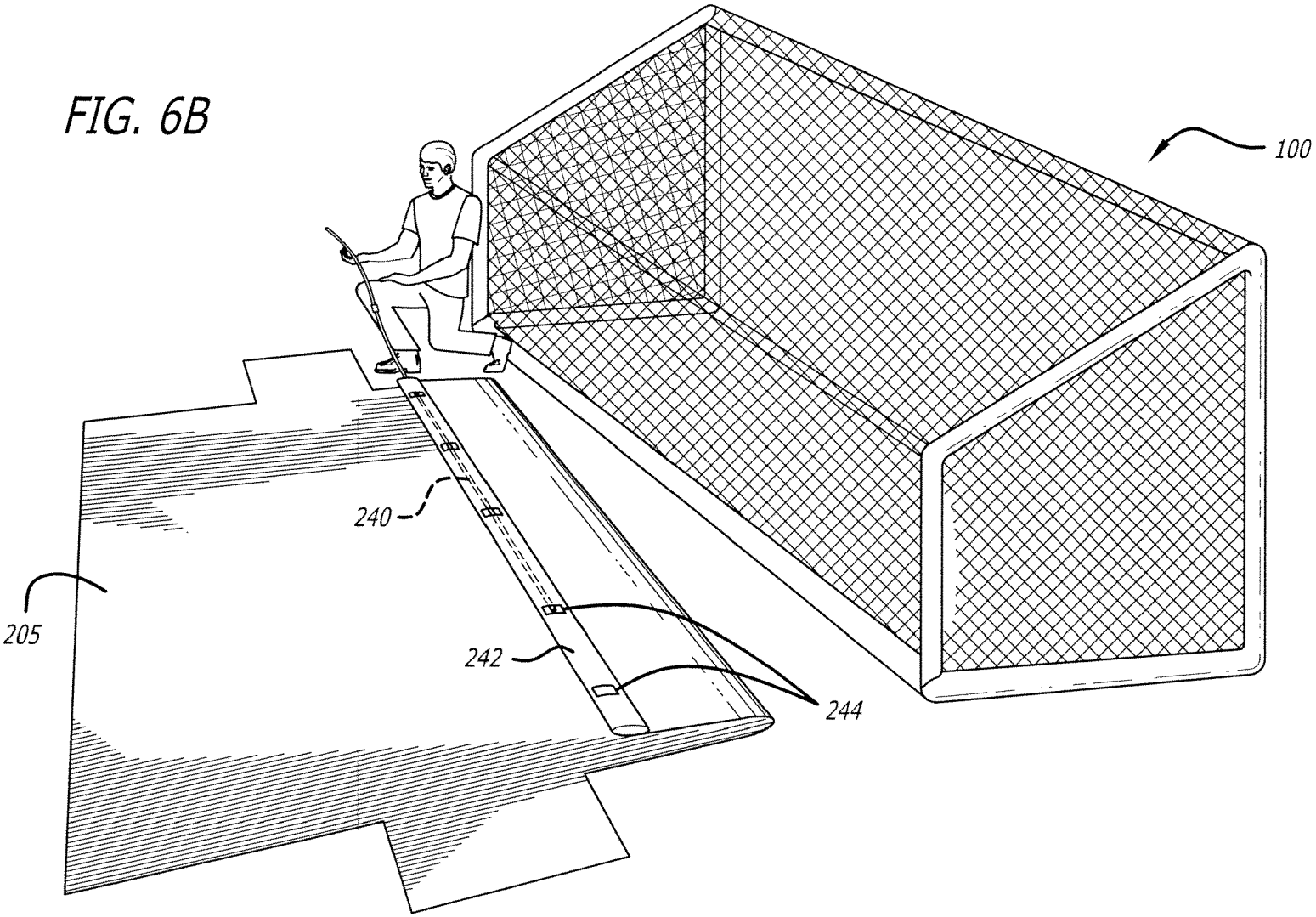

According to embodiments, assembly of GSTS 200 is accomplished by inserting one or more supporting members and affixing to posts 120 and cross bar 110 of goal 100 with straps. According to embodiments shown in FIG. 6A, installation of GSTS 200 is accomplished first by placing one or more supporting members 240, 260 (see FIG. 8) into receivers 242 disposed in goal cover 205. Support members 240, 260 comprise devices, such as poles, that provide increased rigid structure to the GSTS 200. For example, collapsible fiberglass poles that are often used as tent poles may be used as support members 240, 260. Support members 240, 260 may be disposed at the top, bottom, or along the vertical sides of goal cover central portion 206 or goal cover side extension 207 sides, according to embodiments.

Receivers 242 comprise pockets configured to receive supporting members 240. According to embodiments, receivers 242 are disposed across the top and bottom of goal cover 205. According to similar embodiments, receivers 242 are disposed across the top, bottom, and along the vertical sides of goal cover central portion 206.

Figure 7A:
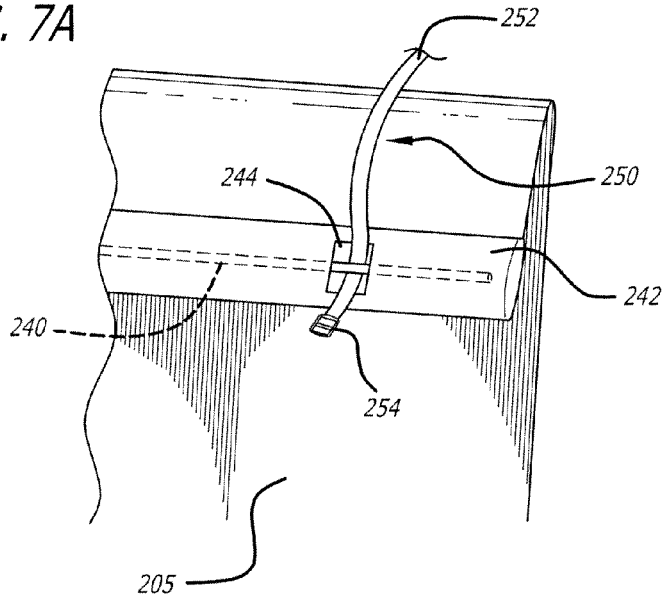
FIGS. 7A and 7B are perspective views of an embodiment of connecting a soccer goal training device to a soccer goal.
Figure 7B:
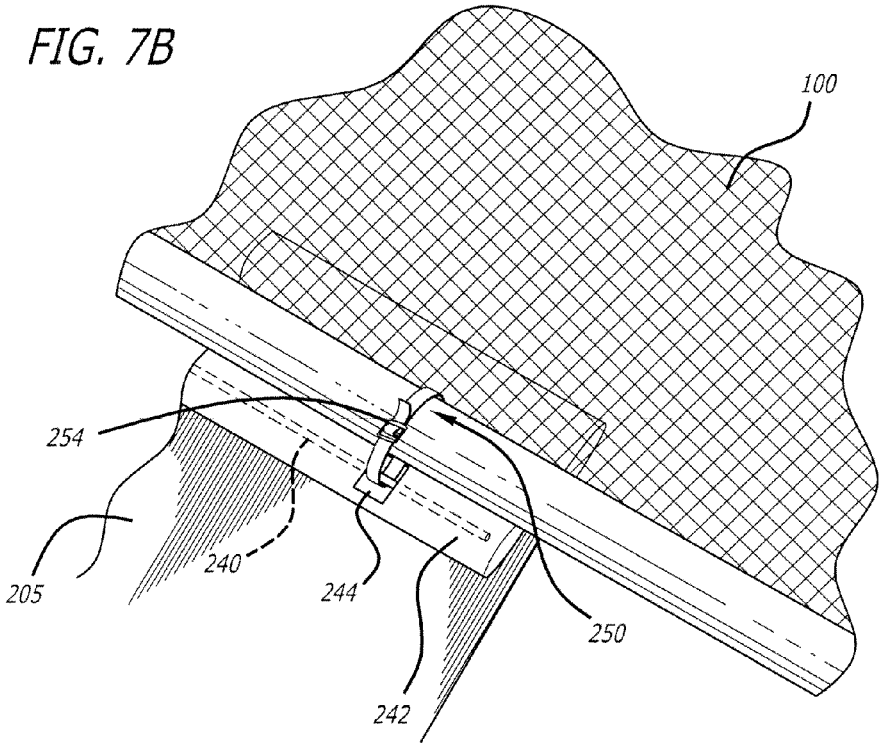

According to embodiments for connecting GSTS 200, after supporting members 240 are disposed into receivers 242 along the portion of goal cover 205 that is to be connected to goal 100 crossbar 110, goal cover 205 is connected to goal 100. One or more straps 250 connect goal cover 205 to goal 100. To connect straps 250 to goal cover 205, one or more connection openings 244 are disposed along receivers 242, which exposes supporting member 240. Each strap 250 is threaded between supporting member 240 and goal cover 205 at least one connection opening 244, as illustrated in FIG. 7A. Thereafter, strap is placed around goal 100 crossbar 110; the loose end of strap 252, according to embodiments, is connected to strap connector 254 and tightened, whereby goal cover 205 is firmly connected to goal 100.

According to embodiments, straps 250 are not connected to support member 240 at bottom of goal cover 205. Similarly according to embodiments, straps may be preattached to goal cover side extensions 207 for connection to side posts 120 of goal 100, or may be attached as disclosed above.

Figure 8:
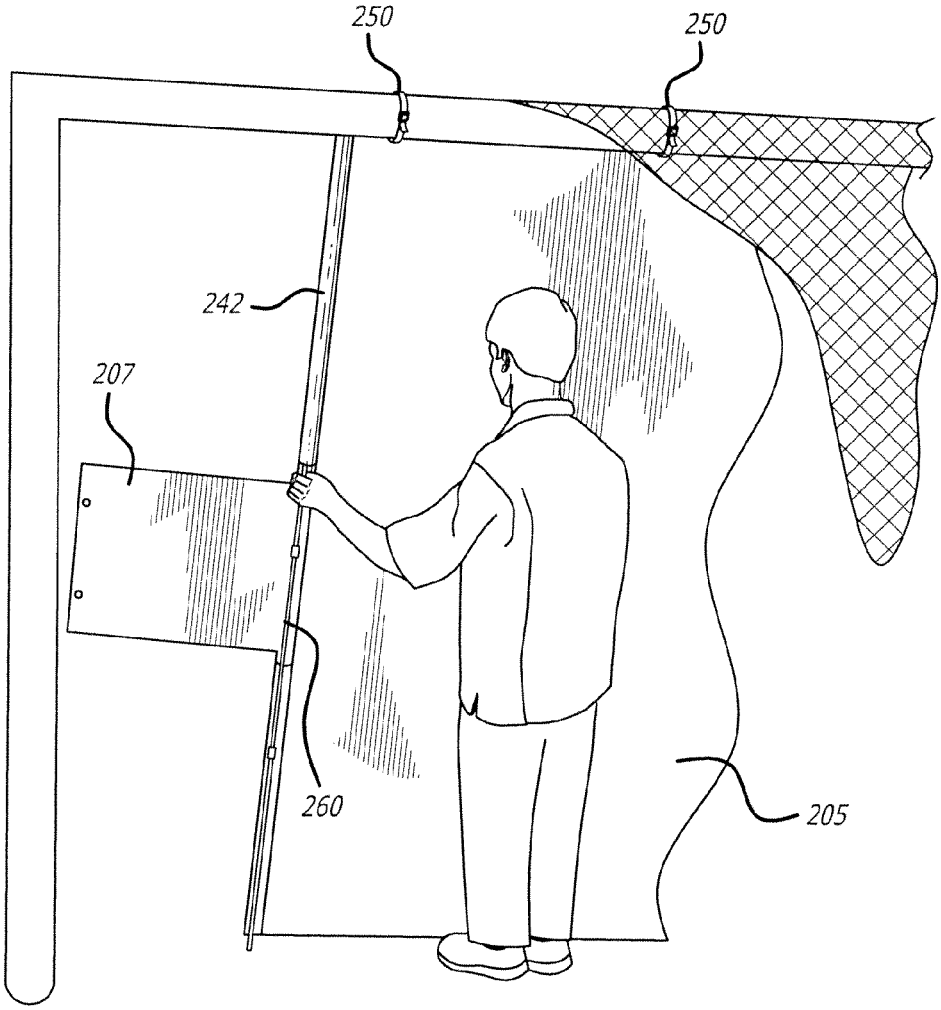
FIG. 8 is a perspective view of an embodiment of a method for connecting a soccer goal shot training device to a soccer goal.

As illustrated by embodiments in FIG. 8, support member 260 disposed in the vertical portion of goal cover 205 is accomplished after connection of GSTS 200 to goal 100. Insertion of support member 260 into receiver 242 is performed similarly as disclosed herein.

Figure 9:
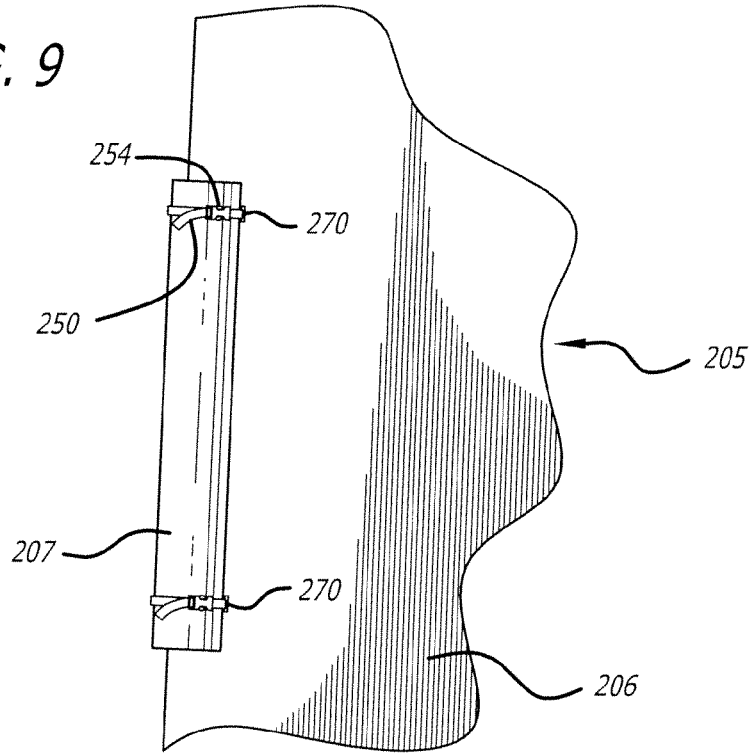
FIG. 9 is a perspective view of an embodiment of a goal shot training system where a goal cover side extension is in a retracted position.

When goal cover side extensions 207 are not used, they may be stored behind goal cover 205. To store the desired goal cover side extension 207, it is rolled up towards the center of goal cover 205, as illustrated in FIG. 9. According to embodiments, there is shown goal cover 205 with goal cover side extension 207 in a retracted position. To retract, goal cover side extension 207 is rolled up. Straps 250 are inserted through securing openings 270 in goal cover 205 and wrapped around rolled up goal cover side extension 207 at one or more locations, according to embodiments. As illustrated in FIG. 9, two straps 250 secure rolled up goal cover side extension 207. Strap connectors 254 secure straps 250 thereby preventing goal cover side extension 207 from unrolling.

Figure 10:
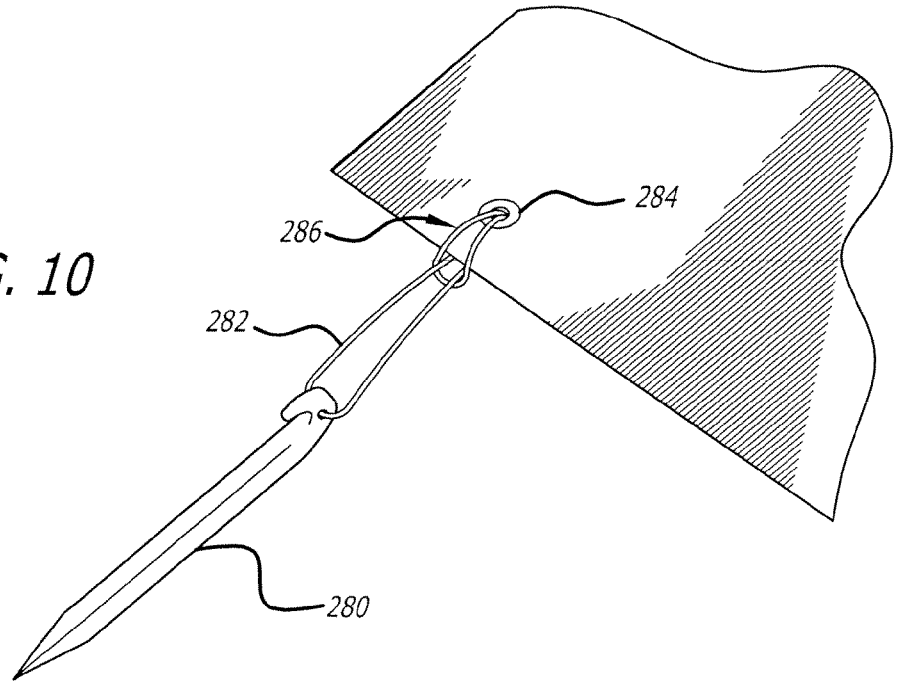
FIG. 10 is a perspective view of an embodiment of a stabilization system for a goal shot training system when a goal cover side extension is in a retracted position.

When one or both goal cover side extensions 207 in a stored configuration, alternate securing devices may be used to secure GSTS 200 in a substantially fixed position relative to goal 100 (i.e., to overcome wind or the force of the ball kicked into GSTS 200), according to embodiments. For example and as illustrated in FIG. 10, securing device 280 coupled to securing connector 282 may be girth hitched 286 to securing opening 284 in goal cover 205. Securing device 280, according to embodiments, is an implement that is driven into the ground, such as a stake. Securing connector 282 is, according to embodiments, rope, cord, or other similar, but elastomeric devices, such as bungee. According to embodiments, securing opening 284 may be placed in each lower corner area of goal cover central portion 206. GSTS 200 may also be secured via rope, cord, bungee, and the like directly to goal posts 120, according to alternate embodiments.

The present disclosure also discloses a method of conditioning soccer players to improve their shooting and increase the likelihood of successful shots on goal 100. The method uses positive viewing spaces 210 and negative viewing spaces 220 to condition players to shoot towards the areas of the goal 100 defined by the positive viewing spaces 210. More specifically, GSTS 200 is provided. GSTS 200 includes both positive viewing spaces 210 and negative viewing spaces 220, as previously described. Once installed in goal 100, players set up and shoot soccer balls towards the goal, aiming at the positive viewing spaces 210. In embodiments, GSTS 200 is used over an extended time to condition the player to look first to positive viewing spaces 210 of goal 100, even in the absence of GSTS 200. As players practice using GSTS 200, they will become conditioned to shoot at the areas of goal 100 that are most likely to produce scores.

Moreover, the present disclosure teaches a business method for generating revenues. According to embodiments, GSTS 200 may be produced for improving the skills of soccer players. Naturally, professional and semi-professional soccer clubs would value a training system that would increase the number of goals scored. As the number of goals scored increases, the number of wins a team is likely to produce will tend to increase, which will induce fans to attend games and purchase goods and services related to the soccer club. Thus, professional clubs stand to increase revenues by conditioning players to shoot first at the areas of the goal most likely to produce a scoring event.

Moreover, according to the teachings of similar methods, providing GSTS's 200 to children and young adult soccer players would improve their skills and make them more likely to be selected for specialized teams, play for college teams, earn scholarships, and to eventually become professional players. Thus, conditioning children and young adults to increase the likelihood of scoring goals using GSTS 200 is an additional value imparted by the teachings of the present disclosure.

While the apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A method comprising:

providing a soccer training device in combination with a soccer goal including configuring an opaque training covering to obscure a net of a soccer goal, the covering forming at least one user-configurable opening that allows a player shooting a soccer ball to see the net of the soccer goal when the covering is affixed to the soccer goal;

the covering being substantially cross shaped, the cross-shape having a body and a pair of arms extending laterally from a body of the covering that extends substantially from the ground to the crossbar;

wherein a user may configure the covering to mimic the range of a goal keeper by at least one of: adjusting the location of the body of the covering relative to the posts, and removing or folding one or both arms whereby the arm no longer obscures the net;

wherein when the covering is affixed to the soccer goal, the combination of the covering and soccer goal comprises at least:

a configuration for shots originating substantially directly in front of the goal consisting of positioning the body and arms of the covering whereby the covering obscures the net except for openings at the top right corner, the top left corner, the bottom right corner, and the bottom left corner of the goal;

a configuration for shots originating at a penalty kick position consisting of positioning the covering whereby the covering obscures the net except for a pair of openings created along each post from the ground to the cross bar; and a configuration for shooting shots from the side of the field consisting of positioning the covering whereby the covering obscures the net except for an opening created along the post furthest from the origin of the shot, the opening being from the ground to the cross bar.

2. The method of claim 1 wherein configuring the opaque training covering to obscure the net of the soccer goal comprises connecting the training covering to the soccer goal to form at least one negative viewing space.

3. The method of claim 1 wherein configuring the opaque training covering to obscure the net of the soccer goal comprises creating openings in the opaque training covering when affixed to the soccer goal allowing a soccer player to see into goal areas in which the net is visible beyond the goal covering, wherein the opaque training covering contrasts with the goal areas that are viewable through the covering and mimics the range of a goal keeper.

4. The method of claim 1 whereby the player is conditioned to instinctually see positive viewing spaces first when a live goal keeper is blocking the soccer goal.

5. The method of claim 1 further comprising providing at least one support member and at least one receiver configured to receive the at least one support member.

6. The method of claim 2 wherein the at least one negative viewing space resembles the arms and torso of a goalkeeper.

7. The method of claim 1, wherein the covering further comprises a plurality of straps configured to be affixed around a top bar of a soccer goal and hold the covering in place relative to the soccer goal.

8. The method of claim 1 wherein configuring the opaque training covering to obscure the net of the soccer goal comprises hanging the goal covering from a crossbar of the soccer goal.

9. A soccer training method comprising:

providing an opaque covering made from a fabric or plastic and adapted to be used in combination with a soccer goal having two upright posts of equal height, a crossbar having two endpoints, each endpoint terminating at each upright post respectively, and a net affixed to the goal, wherein the crossbar is parallel to the ground at a height equal to the height of the posts, the covering being substantially cross shaped, the cross-shape having a body that extends substantially from the ground to the crossbar and a pair of arms extending laterally from a body;

providing a receiver along the top of the covering adapted to receive a supporting member;

creating a plurality of openings in the receiver providing access to the supporting member, and affixing the covering to the crossbar of the soccer goal by affixing a strap to the supporting member, which strap is likewise affixed to the crossbar;

adapting the covering to form a training device having a plurality of configurations, each configuration useful depending on the origin of the shot at the goal by a user, the configurations comprising at least:

a configuration for shots originating substantially directly in front of the goal consisting of positioning the body and arms of the covering whereby the covering obscures the net except for openings at the top right corner, the top left corner, the bottom right corner, and the bottom left corner of the goal;

a configuration for shots originating at a penalty kick position consisting of positioning the covering whereby the covering obscures the net except for a pair of openings are created along each post from the ground to the cross bar; and a configuration for shooting shots from the side of the field consisting of positioning the covering whereby the covering obscures the net except for an opening created along the post furthest from the origin of the shot, the opening being from the ground to the cross bar.

10. The method of claim 9 wherein affixing the covering to the soccer goal comprises forming at least one negative viewing space.

11. The method of claim 10 wherein the at least one negative viewing space imitates the range of a goal keeper.

12. The method of claim 9 further comprising configuring openings in the covering allowing a soccer player to see into goal areas in which the net is visible beyond the covering, wherein the covering contrasts with the goal areas that are viewable through the covering.

13. The method of claim 10 further comprising practicing soccer shots by aiming shots at positive viewing spaces and avoiding shots towards at least one negative viewing space.

14. The method of claim 13 whereby a soccer player is conditioned to instinctually see positive viewing spaces first when a live goal keeper is blocking the soccer goal.

* * * * *